US008566980B2

(12) United States Patent
Grone

(10) Patent No.: US 8,566,980 B2
(45) Date of Patent: Oct. 29, 2013

(54) FOLDING BED WITH A CONTROL LEVER ARRANGED BETWEEN A CABINET UNIT AND A HEAD PART

(75) Inventor: Matthias Grone, Melle (DE)

(73) Assignee: Ferdinand Lusch GmbH & Co., KG, Bielefeld (DE)

( * ) Notice: Subject to any disclaimer, the term of this patent is extended or adjusted under 35 U.S.C. 154(b) by 0 days.

(21) Appl. No.: 13/348,001

(22) Filed: Jan. 11, 2012

(65) Prior Publication Data

US 2013/0145548 A1 Jun. 13, 2013

(30) Foreign Application Priority Data

Dec. 12, 2011 (DE) ..... 10 2011 120 719

(51) Int. Cl.
*A47C 17/52* (2006.01)

(52) U.S. Cl.
USPC ..... 5/136; 5/149; 5/159.1; 5/164.1

(58) Field of Classification Search
USPC ..... 3/136, 149, 150.1, 151–155, 159.1, 3/162, 164.1
See application file for complete search history.

(56) References Cited

U.S. PATENT DOCUMENTS

| | | | | | |
|---|---|---|---|---|---|
| 1,164,594 | A | * | 12/1915 | Caler | 5/140 |
| 1,349,946 | A | * | 8/1920 | Douglass | 5/164.1 |
| 2,641,000 | A | * | 6/1953 | Jonsson | 5/155 |
| 3,755,832 | A | * | 9/1973 | Bennett | 5/2.1 |
| 4,370,766 | A | * | 2/1983 | Teague, Jr. | 5/133 |
| 6,105,185 | A | * | 8/2000 | DiRocco | 5/164.1 |

FOREIGN PATENT DOCUMENTS

| | | | |
|---|---|---|---|
| AT | 009885 | U1 | 5/2008 |
| DE | 7509338 | | 7/1975 |
| DE | 4238226 | A1 | 7/1993 |
| DE | 19729462 | A1 | 1/1999 |

* cited by examiner

*Primary Examiner* — Michael Trettel
(74) *Attorney, Agent, or Firm* — The Webb Law Firm

(57) ABSTRACT

Provided is a folding bed including a cabinet unit and a head part pivotable in relation to the cabinet unit, wherein the head part, in an unused position, is positioned in an approximately vertical orientation in the cabinet unit and in a usage position in an approximately horizontal orientation at least in sections in front of the cabinet unit. The head part can be pivoted from the unused position into the usage position and back. In order to further reduce the space required for the folding bed, the cabinet unit and head part are connected together via a control lever that is held pivotable about a pivot axis on the cabinet unit and a pivot axis on the head part. The control lever is designed such that on movement of the head part from the unused position into the usage position and back, it is pivoted against the cabinet unit.

18 Claims, 6 Drawing Sheets

FOLDING BED WITH A CONTROL LEVER ARRANGED BETWEEN A CABINET UNIT AND A HEAD PART

BACKGROUND OF THE INVENTION

1. Field of the Invention

The invention concerns a folding bed with a cabinet unit and a head part pivotable in relation to the cabinet unit, wherein the head part in an unused position is positioned in an approximately vertical orientation in the cabinet unit and in the usage position is positioned in an approximately horizontal orientation at least in sections in front of the cabinet unit, and wherein the head part can be moved from the unused position into the usage position and back.

2. Description of Related Art

Folding beds of the said type have been known for a long time in various designs. Depending on the orientation of the lying surface to the cabinet unit, these are known as longitudinal and transverse sleeper models. In longitudinal sleeper models, the lying surface can be made of one piece or foldable. Folding lying surfaces usually have at least one head part and one foot part, irrespective of whether or not the lying surface is folding.

In known folding beds, in the unused position at least the head part is held in the cabinet unit, for space reasons in a substantially vertical position. In the usage position in which a person can lie on the lying surface formed by the folding bed, the head part is however oriented horizontally.

From the unused position, at least the head part can be pivoted forward out of the cabinet unit. To this end the head part and the cabinet unit are connected pivotably together.

A cabinet unit in the present case means any type of housing in which at least the head part is held, visibly or invisibly, in the unused position. Thus for example the front visible side of the cabinet unit can be formed by part of the lying surface when this is arranged in the unused position. Preferably a cabinet unit is a typical cupboard or wardrobe-like item of furniture to hold at least the head part. The cabinet unit can preferably be made substantially of a wooden material and if necessary can have a cupboard door to close the cabinet unit when at least the head part in the unused position is held in the cabinet unit.

Known folding beds however still have the disadvantage that in the usage position and/or in the unused position, these require a not inconsiderable amount of space. This is a problem in particular in small rooms in which the benefits of a folding bed are particularly useful. Finally there is a further need for optimisation with regard to the space required by folding beds.

The folding bed described in AT 009 885 U1 takes up a lot of space in the usage position because the head end of the lying surface is spaced not unsubstantially from the inner wall of the cabinet. This problem is solved in the folding bed described in DE 197 29 462 A1 by the head side end of the lying surface being stationary. However the cabinet unit must be formed deeper by the length of the stationary end of the lying surface in order to be able to hold the head part and the foot part as a whole. The corresponding folding bed therefore takes up more room in the unused position.

The object of the present invention is therefore to design a folding bed of the type cited initially and described in detail above, and refine this such that the space required can be reduced further.

SUMMARY OF THE INVENTION

This object is achieved with a folding bed according to the preamble of claim 1 in that the cabinet unit and head part are connected together via a control lever, that the control lever is held pivotable about a pivot axis on the cabinet unit, that the control lever is held pivotable about a pivot axis on the head part, and that the control lever is formed such that on adjusting the head part from the unused position into the usage position and back, it is pivoted in relation to the cabinet unit.

The control lever and its arrangement pivotable both on the cabinet unit and on the head part ensure that the end of the head part facing the cabinet unit can be arranged very close to the back of the cabinet unit in both the unused position and in the usage position. Consequently by corresponding adaptation and design of the control lever, it can be achieved that no space is wasted unnecessarily in either the usage position or in the unused position.

The optimum utilisation of the space available is for example finally made possible in that the pivot lever, on adjusting the head part from the unused position into the usage position, is first moved away from the rear wall of the cabinet unit so that there is sufficient distance between the rear wall of the cabinet unit and the head part to pivot the rear end of the head part past the rear wall of the cabinet unit. Before reaching the usage position however the control lever also allows the head part to be moved back again in the direction of the rear wall of the cabinet unit. In other words the control lever because of its arrangement previously described allows the head part to move to and fro in the horizontal direction on movement from the unused position into the usage position and back.

Where the present text refers to at least one head part or mainly one head part, without a foot part being required by explicit naming of a foot part or its necessary presence for technical reasons, the presence of a foot part is not necessary. The head part can thus be the head part of an undivided lying surface which in particular is allocated to the rear wall of the cabinet unit in the usage position. The head part can however also be the head part of a folding i.e. preferably multipiece lying surface, wherein the head part is then also allocated to the rear wall of the cabinet unit in the usage position.

As well as the head part, a foot part is provided which forms the part of the lying surface facing away from the head part. The foot part is preferably joined to the head part in particular in the case of a two-piece lying surface. This is not however necessary, in particular if the lying surface is composed of more than two parts which are all foldable against each other. Finally between the head part and the foot part, where applicable in the usage position of the lying surface or head part, a further part or several further parts can be provided.

For design and cost reasons, the control lever is preferably a one-piece lever. The control lever can however if necessary also be made of several pieces. Also the control lever can be connected indirectly or directly i.e. via further components with the cabinet unit and the head part. The cabinet unit preferably has a screw tab, in particular if the body of the cabinet unit is made of a wooden material, so that this can tolerate the forces applied without problem. Also the control lever can be joined to a further lever or levers which are not directly necessary or useful for adjusting the head part. If necessary the control lever can specify and/or define further movements of the folding bed such as pivoting of leg units of the folding bed or further parts of the lying surface.

In a first preferred embodiment of the folding bed the control lever is formed such that on movement from the unused position to the usage position starting from the unused position, it is pivoted forward about the pivot axis on the cabinet unit. Thus the head part is moved sufficiently far forward and out of the cabinet unit so that on pivoting, the head part does not collide with the rear wall of the cabinet unit.

Alternatively or additionally the control lever can be formed, on movement from the unused position into the usage position starting from the unused position, to pivot down about the pivot axis on the cabinet. Thus for example the force of gravity of at least the head part can be used to move this out of the unused position.

Alternatively or additionally the control lever can be formed, on movement of the head part from the unused position to the usage position starting from the unused position, not to pivot or scarcely to pivot about the pivot axis on the head part. The head part is then mainly pivoted about the pivot axis on the cabinet unit, wherein the head part can already be moved suitably forward i.e. away from the rear wall of the cabinet unit. Further movements are not necessary with a suitable design of the control lever and need therefore not be depicted structurally.

To ensure that the head part in the usage position is positioned as close as possible to the rear wall of the cabinet unit, the control lever can be designed, on movement of the head part from the unused position into the usage position starting from an intermediate position between the unused position and the usage position, to pivot back about the pivot axis on the cabinet unit. The head part is thus moved correspondingly back into the cabinet unit. This is recommended in particular if the head part, on movement from the unused position into the intermediate position, has previously been pivoted forward at least over a particular adjustment range. Pivoting forward means pivoting in a direction out of the cabinet unit and pivoting back means pivoting in the direction into the cabinet unit.

Alternatively or additionally the control lever can be designed, on movement from the unused position into the usage position starting from the intermediate position, to pivot upward about the pivot axis on the cabinet unit. This can compensate for example for a downward pivoting of the control lever during at least part of the movement from the unused position of the head part to its intermediate position. Alternatively or additionally it can thus be ensured that in the usage position and/or in the unused position, sufficient distance is maintained between the head part and the floor.

The control lever can alternatively or additionally be designed, on movement of the head part from the unused position into the usage position starting from the intermediate position, to be pivoted about the pivot axis at the head part. Only after passing the intermediate position is there a need for additional pivoting about the pivot axis of the control lever on the head part to ensure that the head part assumes a space-saving position in the usage position. If necessary a corresponding pivoting of the control lever about the head part may only be possible after the intermediate position, in order to avoid a collision of the head part with the rear wall of the cabinet unit. The intermediate position can thus if necessary be reached in a position in which the forward movement of the head part is complete and the rearward movement of the head part back has just begun, insofar as the head part is moved from the unused position into the usage position. If the head part is moved from the usage position into the unused position, the movements described above can take place in the reverse order.

If movement of the head part from the unused position into the intermediate position and/or the usage position and back is to be guided to a great extent so that more or less only predetermined movement sequences can take place on movement of the head part, a further control lever can be provided which also joins the head part to the cabinet unit and is mounted rotatably both on the cabinet unit and on the head part.

In this context it may be particularly preferred if at least one lever arm of a guide lever is formed such that, starting from the unused position of the head part, it can be pivoted up from a downward directed position into an approximately, preferably substantially, horizontal position, into the intermediate position of the head part. This pivot movement of the lever arm can be utilised, on movement of the head part from the unused position into the intermediate position, to move the head part away from the rear wall of the cabinet unit so that the head part, on movement from the unused position, does not collide with the rear of the cabinet unit. By simultaneous pivoting of the control lever, the head part is force-guided on movement from the unused position into the intermediate position and back. The operator need not therefore concern himself further when adjusting the folding bed.

Alternatively or additionally the at least one lever arm of the guide lever can be formed such that, starting from the intermediate position of the head part, it is pivoted from an approximately, preferably substantially, horizontal position into an upward directed position in the usage position of the head part. As a result the head part moves from a position spaced from the rear wall of the cabinet unit into a position closer to the rear wall of the cabinet unit to avoid wasting space unnecessarily. In this case too by simultaneous pivoting of the control lever, the head part can be force-guided on movement from the intermediate position into the usage position and back. The operator need not therefore concern himself further when adjusting the folding bed.

If necessary the at least one lever arm of the guide lever can also be regarded as the control lever itself. The lever arm of the guide lever, which then is also the control lever, can therefore suffice to achieve the desired movement of the head part without collision with the rear wall of the cabinet unit if the lever arm, in the sense of the control lever, is pivoted from a downward directed position into an approximately horizontal position and/or from the more horizontal position into an approximately upward directed position. The combination of guide lever and control lever is however preferred for the reasons cited.

Also at least one spring means can be provided which is connected with opposite ends firstly to the cabinet unit and secondly to the head part and/or control lever on the other. This can be achieved in a manner such that the return force of the at least one spring means counters the movement of the head part from the unused position into the intermediate position. This achieves for example that the movement of the head part from the unused position in the direction of the usage position or intermediate position must take place against the corresponding spring force. Thus the head part in the unused position is held securely and stably in a preferably vertical alignment in the cabinet unit. This contributes to increased safety on use of the folding bed.

The at least one spring means can also be provided such that the return force of the at least one spring means counters the movement of the head part from the usage position into the intermediate position. This achieves for example that the movement of the head part from the usage position in the direction of the unused position or intermediate position must take place against the corresponding spring force. Thus the head part in the usage position is held securely and stably in a preferably horizontal orientation in front of the cabinet unit. This increases the safety on use of the folding bed.

In a particularly preferred embodiment of the folding bed, at least two spring means are provided. The at least two spring means are connected with opposing lever arms of a guide lever held rotatably on the cabinet unit between the lever arms. In this way as required a type of rocker spring-loaded on both sides is achieved. This can serve to support the user of the folding bed on adjusting this from the unused position to the usage position. The support can for example be in the form that during particular sections of movement of the head part, the user applies forces which are overlaid positively, i.e. at least partly cumulated, with the return forces of the spring means. The support can alternatively or additionally consist, in any case during particular sections of movement of the head part, of the user having to apply particular forces to move the head part further so that for example accidental movement can be avoided. Thus in certain positions of the head part so-called pressure points can be generated which for example guide the movement of the head part better and/or improve its quality.

Particularly preferably from a design aspect at least one spring means is formed as a gas compression spring or gas pressure strut. The at least one gas compression spring can be arranged such that on movement of the head part from the unused position into the used position it is compressed as a whole, although not necessarily continuously. Otherwise, the head part on movement into the usage position could fall against the user and injure the user or children at play, or damage the folding bed.

Here it can be particularly suitable if the effective lever arm of the gas pressure strut in relation to the guide lever is greater in the unused position and/or in the intermediate position than in the usage position. The force exerted by the gas pressure strut in the usage position of the head part can be kept so low that the gas pressure strut does not counter the safe fixing of the head part in the usage position, preferably however allows the movement of the head part from the usage position in the direction of the unused position and preferably supports this.

In a further preferred folding bed a foot part is provided connected pivotably with the head part. The head part and the foot part can be folded together in the respective unused positions such that the back sides of the head part and foot part facing away from the support side are arranged next to each other. Thus with compact dimensions, the folding bed can be stowed neatly in the cabinet unit. It also avoids the lying surfaces lying on each other in the unused position. This could lead to damage or early wear of the lying surface. The corresponding back sides can be positioned adjacent to each other and/or lie on each other for the purposes of better use of the space.

In the connecting zone between the head part and the foot part, alternatively or additionally at least one leg unit can be provided to support the head part and/or foot part against the floor in the usage position. Here it is suitable if the leg unit is mounted pivotably on the head part and/or foot part in such a manner that the leg unit, on movement of the head part and/or foot part from the unused position into the usage position, is force-pivoted from the unused position into a usage position. The extension and erection of the folding bed into the usage position is thus simplified. It is particularly preferred if the erection of the leg unit is achieved by the change in angle between the head part and the foot part on movement of the folding bed from the unused position into the used position. The reliable pivoting of the leg unit can thus be ensured.

If necessary also a further leg unit can be mounted pivotably at the end of the foot part facing away from the head part. This can serve to support the front end of the foot part in relation to the floor. Preferably the leg unit is connected with the leg unit provided in the connecting zone between the head part and the foot part, in particular such that the two leg units are force-pivoted from the unused position into the usage position on movement of the head part and/or foot part from the unused position to the usage position. Thus the two leg units can be coupled together via a coupling lever for common pivoting. Thus for example the change in angle between the head part and the foot part during movement from the unused position to the usage position and back can be utilised to pivot both leg units out automatically into a function position and on return movement pivot them automatically back into the non-function position.

BRIEF DESCRIPTION OF THE DRAWINGS

The invention is now explained in more detail below with reference to a drawing showing merely one embodiment example. The drawing shows.

DESCRIPTION OF THE PREFERRED EMBODIMENTS

Figure 1:
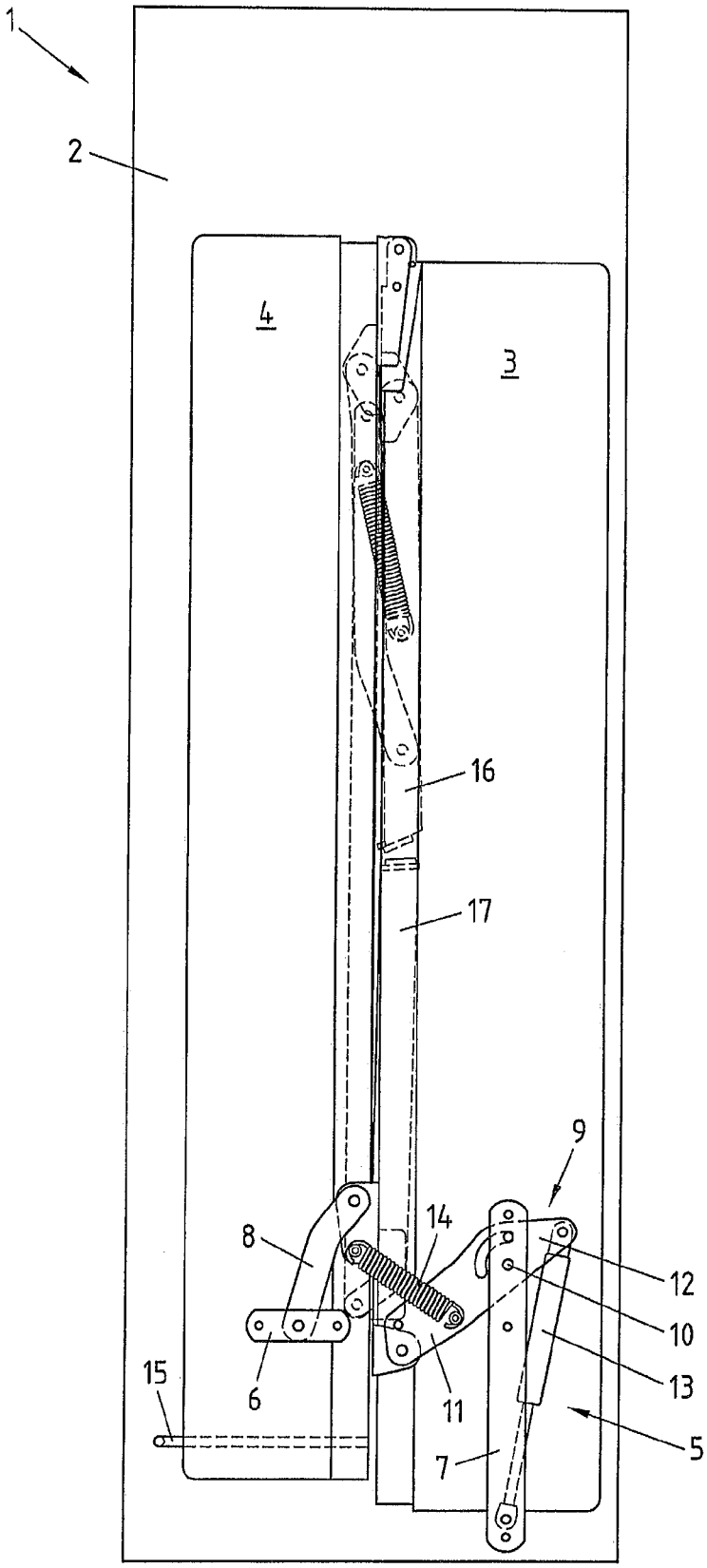
FIG. 1 an embodiment of a folding bed according to the invention in the unused position in diagrammatic side view.

FIG. 1 shows a folding bed 1 with a cabinet unit 2 which holds a head part 3 and a foot part 4. The head part 3 and foot part 4 are oriented substantially vertically and in an unused position from which the foot part 4 and head part 3 can be pivoted into a usage position in which the two form a common substantially horizontal lying surface.

The head part 3 is fixed by a fitting 5 to the cabinet unit 2. The fitting 5 has two connecting tabs 6, 7, of which one connecting tab 6 is connected rotatably with a control lever 8. The control lever 8 is also attached rotatably to the head part 3.

On the other connecting tab 7 provided further in on the cabinet unit 2, a guide lever 9 is mounted rotatably about a rotation axis, wherein the guide lever 9 has a lever arm 11, 12 on both sides of the rotation point 10. One of these lever arms lying in the front of the lever arm 12 pointing to the back of the cabinet unit 2 is connected rotatably with a gas pressure strut 13 which is in turn connected rotatably with the connecting tab 7. Alternatively the gas pressure strut 13 can also be connected with an additional connecting tab. The other lever arm 11 of the guide lever 9 is connected on one side rotatably with the head part 3 and also via a spring means 14 with the head part 3.

Figure 2:
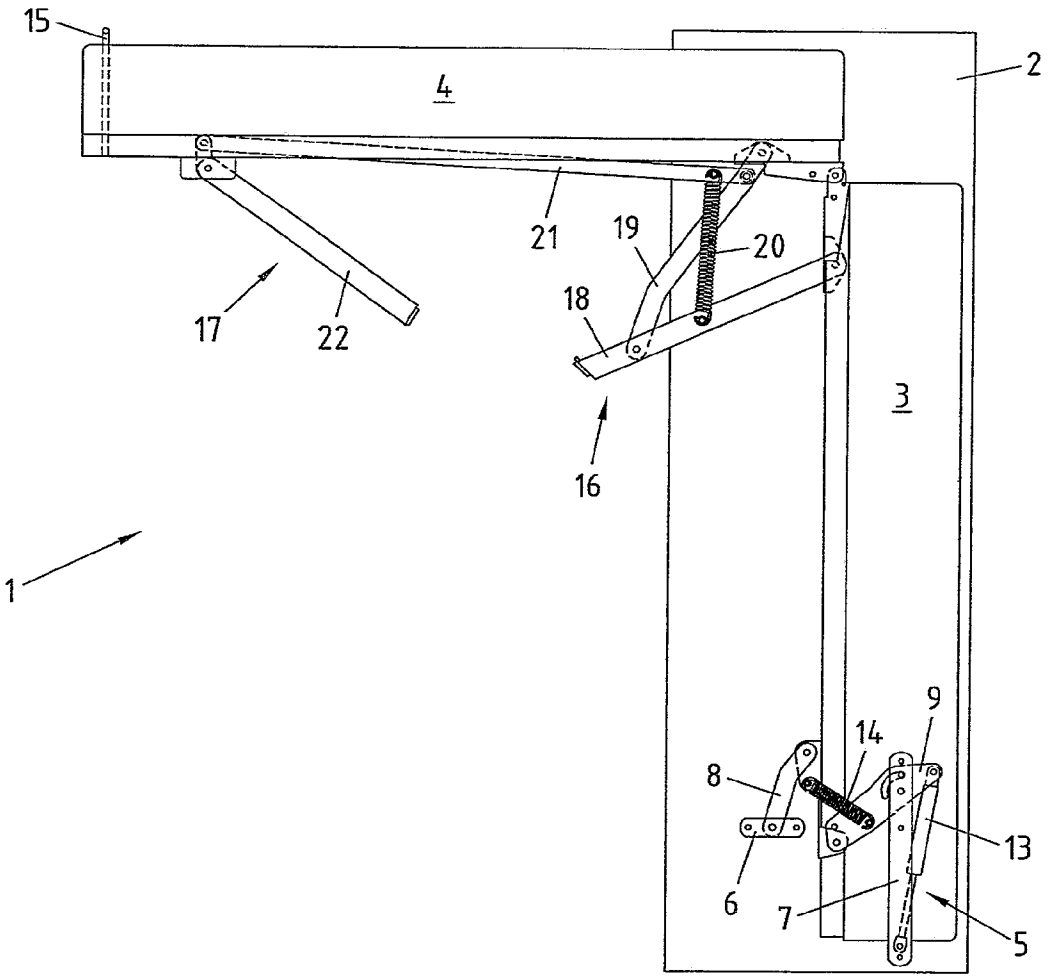
FIG. 2 the folding bed in FIG. 1 with head part and foot part at an approximate right angle to each other in a diagrammatic side view.

Starting from the unused position of the folding bed 1 shown in FIG. 1, the foot part 3 can be gripped on a gripper element 15 and pivoted up out of the cabinet unit 2 as shown in FIG. 2. The head part 3 retains its position unchanged. The foot part 4 in the unused position shown in FIG. 2 is oriented approximately at right angles to the head part 3. Consequently the leg units 16, 17 allocated to the connecting region between the head part 3 and foot part 4 and the outer end of the foot part 4 are partly folded out from the substantially vertical alignment shown in FIG. 1 in relation to the foot part 4. For this the leg unit 16 allocated to the connecting region of the head part 3 and foot part 4 has a leg 18 connected rotatably with the foot part 3 and a support lever 19 connected rotatably with the leg 18 and the foot part 3, wherein the leg 18 is also connected via a spring means 20 with a drive rod 21. Via the drive rod 21 the leg unit 17 allocated to the front end of the foot part 4 is connected with the leg unit 16 allocated to the connecting region between the head part 3 and the foot part 4 and there with the support lever 19. Thus a pivoting of the support lever 19 causes a substantially similar pivoting of the leg 22 allocated to the front end of the foot part 4 via the drive rod.

From the position shown in FIG. 2 the folding bed 1 can be moved into the intermediate position shown in FIG. 3. For this the foot part 4 is drawn forward out of the upper position, whereby the head part 3 is tipped forward out of the substantially vertical position. Consequently the foot part 4 connected rotatably with the head part 3 at its front end is moved increasingly down in the direction of the floor. At the same time the leg 18 of the head part 3 is pivoted away further from this, whereby the leg 18 of the head part 3 is erected further. As a result of the coupling of the leg 18 of the head part 3 and the leg 22 of the foot part 4, the latter is also increasingly erected.

Figure 3A:
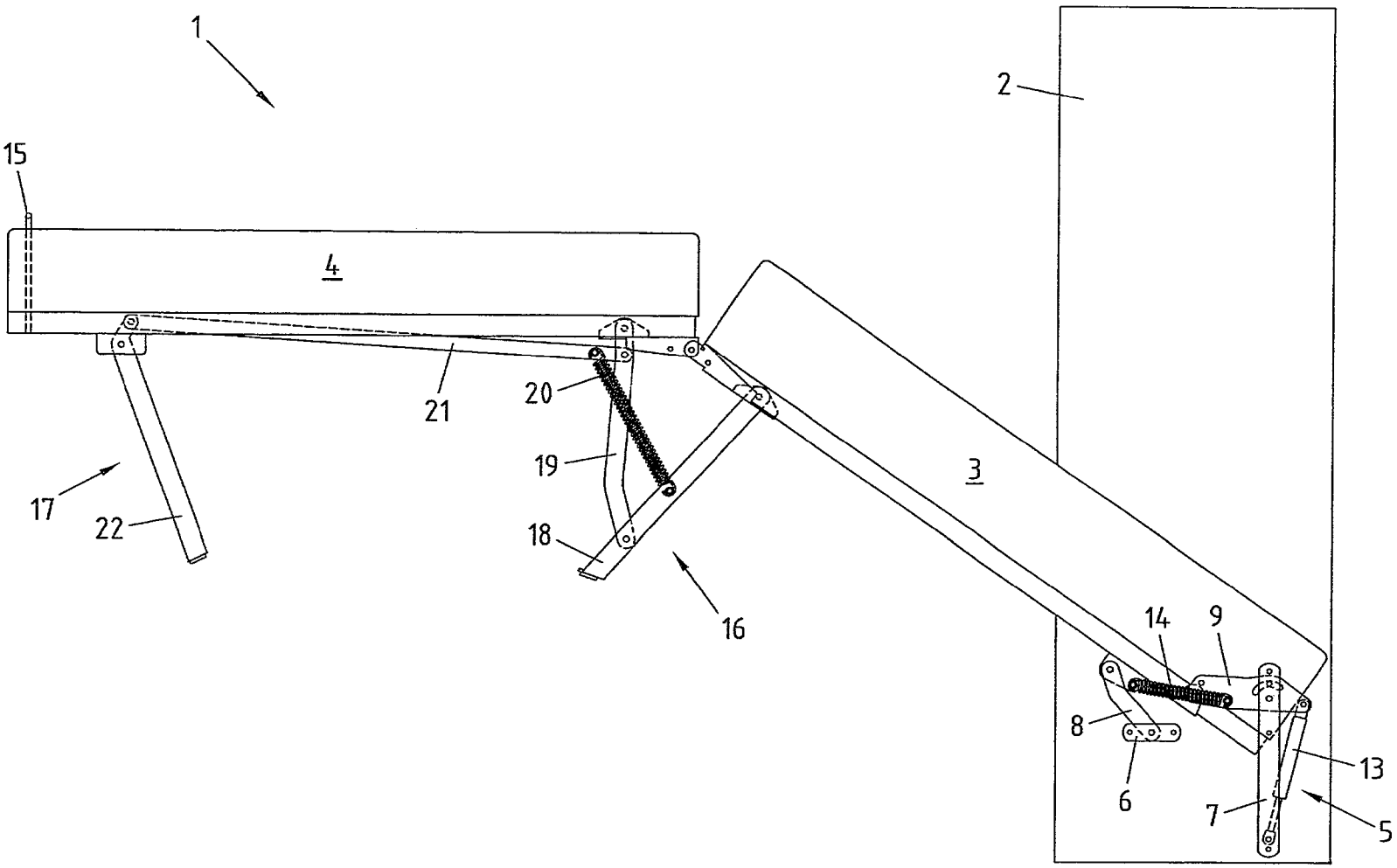
FIG. 3*a* the folding bed of FIG. 1 in the intermediate position in a diagrammatic side view.
Figure 3B:
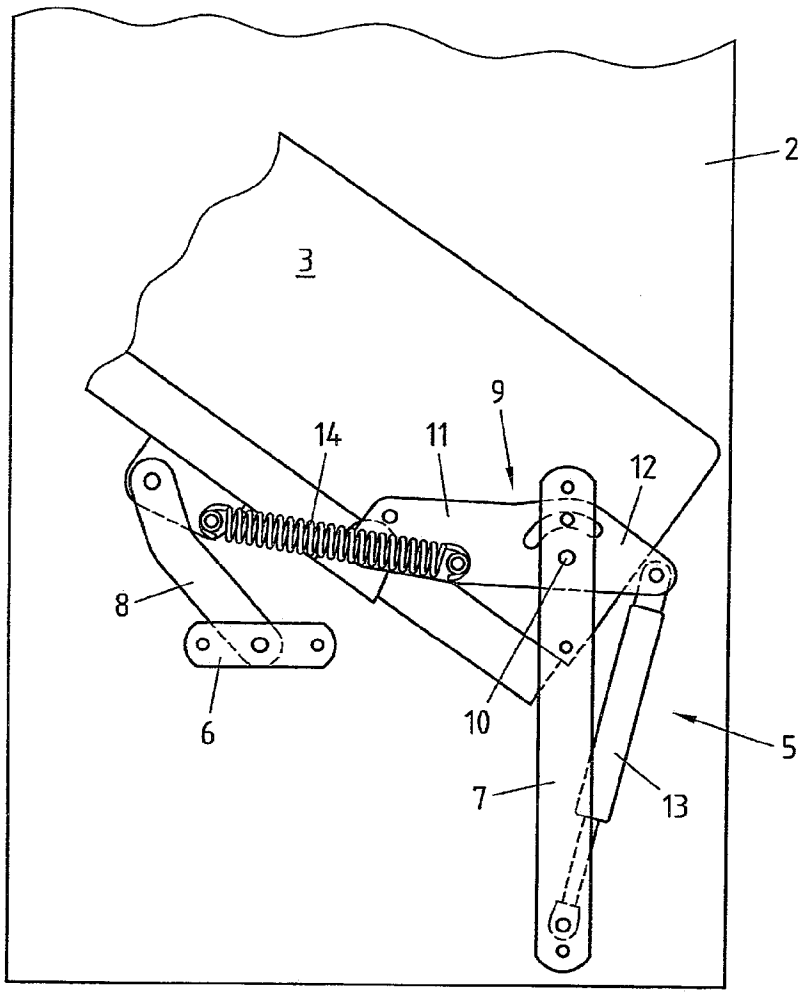
FIG. 3*b* a detail of the folding bed from FIG. 3*a;*

On pivoting of the head part 3 into the intermediate position shown in FIG. 3*a* and FIG. 3*b*, the head part 3 is simultaneously pushed forward. The control lever 8 is pivoted forward about the allocated connecting tab 6, whereby adjacent to the rear wall of the cabinet unit 2 sufficient space is obtained so that the head part 3 can be pivoted out of the vertical into a horizontal position without colliding with the rear wall of the cabinet unit 2. The movement of the head part 3 in the folding bed 1 shown and preferred is guided further by the guide lever 9. The lever arm 11 connected with the head part 3 of the guide lever 9 is moved out of a downward directed orientation in the unused position of the folding bed 1 into a substantially horizontal position in the intermediate position. The connecting point between the head part 3 and the lever arm 11 allocated to this of the guide lever 9 is consequently pivoted upward and forward. At the same time the gas compression spring 13 connected with the other lever arm 12 is partly compressed and the spring means 14 arranged between the lever arm 11 of the guide lever 9 connected with the head part and the head part 3 is extended.

Figure 4A:
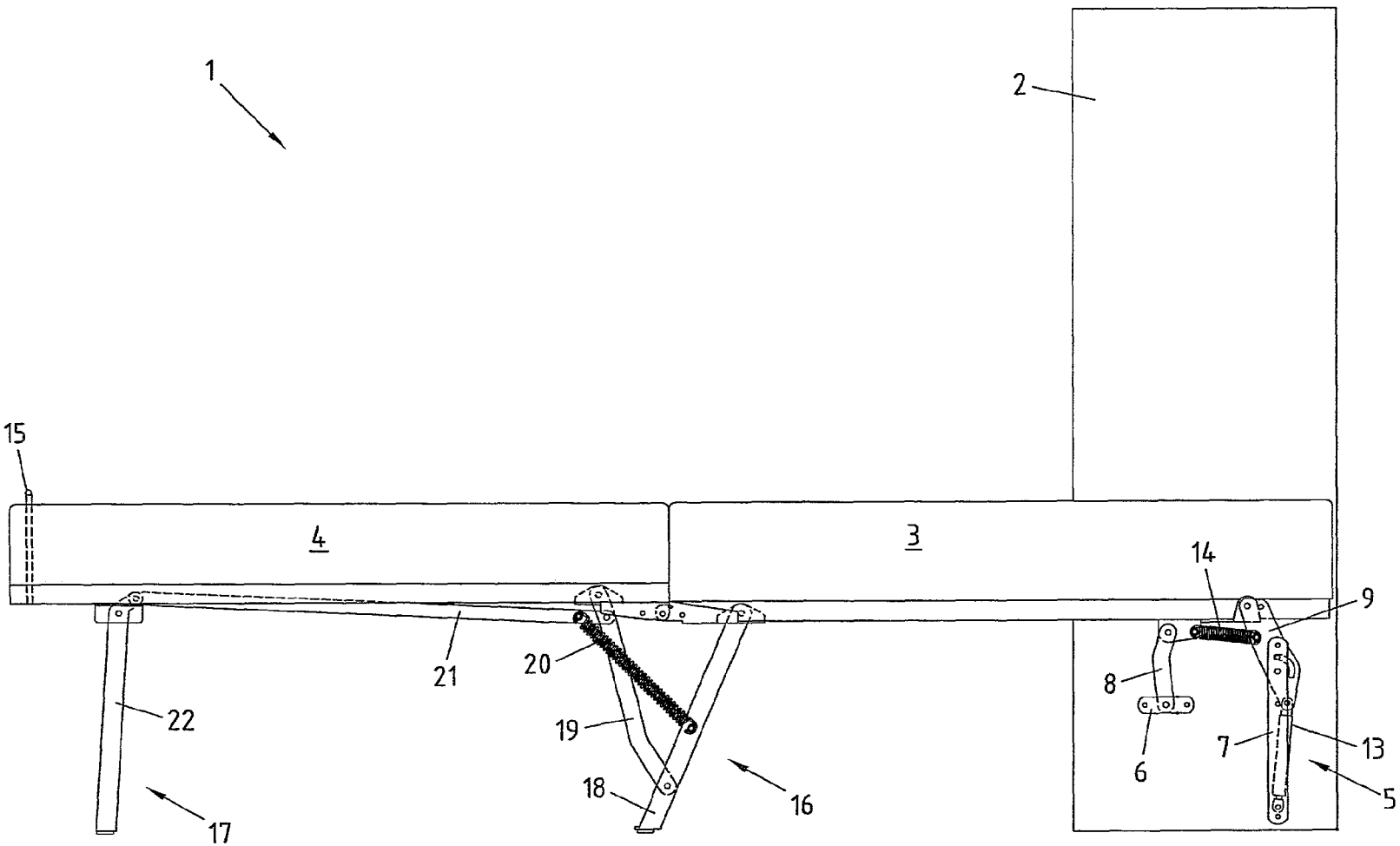
FIG. 4*a* the folding bed of FIG. 1 in the usage position in a diagrammatic side view.
Figure 4B:
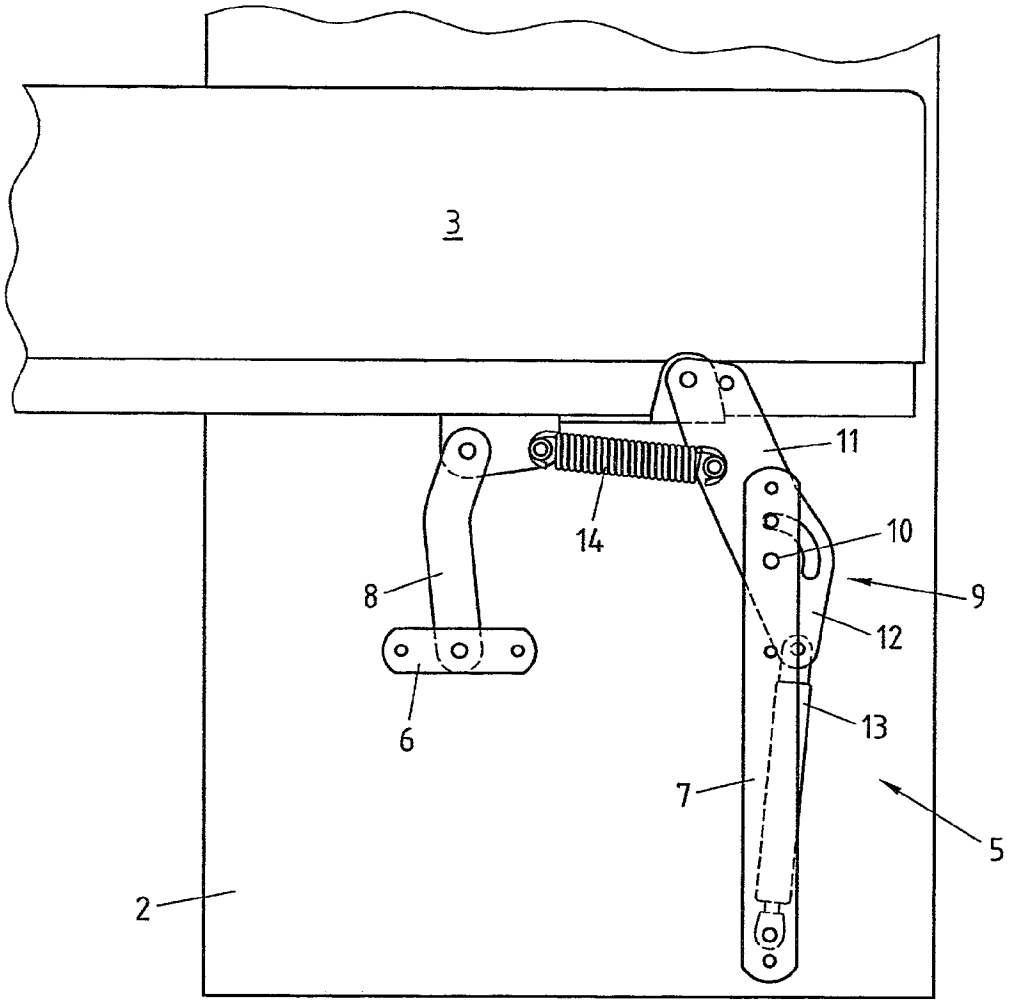
FIG. 4*b* a detail of the folding bed from FIG. 4*a*.

On further movement of the folding bed 1 into the usage position shown in FIGS. 4*a* and 4*b* in which a person can lie on the horizontal lying surface, this guide lever 9 is twisted further until the lever arm 11 connected with the head part 3 of the guide lever 9 stands further up. At the same time the control lever 8 is pivoted further up and back about the connecting tab 6. This achieves that the head part 3 is moved back again in the direction of the rear wall of the cabinet unit 2 so that the lying surface moves very close to the rear wall of the cabinet unit 2. At the same time the spring element 14 between the head part 3 and the lever arm 11 of the guide lever 9 allocated to the head part 3 is compressed again and the gas compression spring 13 compressed further, namely by the lever arm 12 allocated to the gas compression spring 13 of the guide lever 9. In parallel the leg units 16, 17 are pivoted out further as shown in FIG. 4.

The invention claimed is:

1. A folding bed comprising a cabinet unit and a head part pivotable in relation to the cabinet unit, a control lever which connects the cabinet unit and the head part together, wherein the control lever is held pivotable about a pivot axis on the cabinet unit and the control lever is held pivotable about a pivot axis on the head part, wherein the head part, in an unused position is positioned in an approximately vertical orientation in the cabinet unit and in a usage position in an approximately horizontal orientation at least in sections in front of the cabinet unit, wherein the head part can be pivoted from the unused position into the usage position and back, the control lever, on movement of the head part from the unused position into the usage position and back, is pivoted against the cabinet unit, and a foot part connected pivotably with the head part wherein the head part and the foot part are folded together in the respective unused positions such that a rear side of the head part and a rear side of the foot part, facing away from support sides of the head part and foot part, are arranged adjacent to each other.

2. The folding bed according to claim 1, wherein on movement from the unused position into the usage position, starting from the unused position, it is pivoted forward about the pivot axis on the cabinet unit.

3. The folding bed according to claim 1, wherein, on movement of the head part from the unused position into the usage position, starting from the unused position, the control lever is pivoted down about the pivot axis on the cabinet unit.

4. The folding bed according to claim 1, wherein, on movement of the head part from the unused position into the usage position starting from an intermediate position between the unused position and the usage position, the control lever is pivoted back about the pivot axis on the cabinet unit.

5. The folding bed according to claim 1, wherein, on movement of the head part from the unused position into the usage position starting from an intermediate position between the unused position and the usage position, the control lever is pivoted up about the pivot axis on the cabinet unit into a cabinet of the cabinet unit.

6. The folding bed according to claim 1, further comprising at least one lever arm of a guide lever in which when starting from the unused position of the head part, the at least one lever arm is pivoted from a downward directed position up into an approximately horizontal position into an intermediate position of the head part, between the unused position and the usage position.

7. The folding bed according to claim 1, further comprising at least one lever arm of a guide lever, in which when starting from an intermediate position of the head part, between the unused position and the usage position, the at least one lever arm is pivoted from an approximately horizontal position into an upward directed position, in the usage position of the head part.

8. The folding bed according to claim 1, further comprising at least one spring means connected with opposite ends firstly to the cabinet unit and secondly to the head part and/or the control lever so that a return force of the at least one spring means counters the movement of the head part from the unused position into an intermediate position between the unused position and the usage position.

9. The folding bed according to claim 8, wherein the return force of the at least one spring means counters the movement of the head part from the usage position into the intermediate position.

10. The folding bed according to claim 8, further comprising at least two spring means connected with opposite lever arms of a guide lever held rotatably between the lever arms on the cabinet unit.

11. The folding bed according to claim 10, wherein the at least one spring means is formed as a gas pressure strut and arranged such that the gas pressure strut is compressed on movement of the head part from the unused position to the usage position.

12. The folding bed according to claim 11, wherein the lever arm of the at least one spring means formed as a gas pressure strut is arranged such that the lever arm of the gas pressure strut, in relation to the guide lever, is greater in the unused position and/or in the intermediate position than in the usage position.

13. The folding bed according to claim 1, further comprising a first leg unit positioned in a connecting region between the head part and the foot part, wherein the first leg unit also supports the head part and/or the foot part against a floor in the usage position and wherein the first leg unit is force-pivoted from the unused position into a usage position on movement of the head part and/or the foot part from the unused position to the usage position.

14. The folding bed according to claim 13, further comprising a second leg unit, positioned on the end of the foot part which faces away from the head part, pivotably mounted and connected with the first leg unit wherein the first leg unit and the second leg units are force-pivoted from the unused position into a usage position on movement of the head part and/or the foot part from the unused position into the usage position.

15. The folding bed according to claim 4, wherein, on movement of the head part from the unused position into the usage position starting from the intermediate position, the control lever is pivoted up about the pivot axis on the cabinet unit into a cabinet of the cabinet unit.

16. The folding bed according to claim 9, further comprising at least two spring means connected with opposite lever arms of a guide lever held rotatably between the lever arms on the cabinet unit.

17. The folding bed according to claim 16, wherein the at least one spring means is formed as a gas pressure strut and arranged such that the gas pressure strut is compressed on movement of the head part from the unused position to the usage position.

18. The folding bed according to claim 17, wherein the lever arm of the at least one spring means formed as a gas pressure strut is arranged such that the lever arm of the gas pressure strut, in relation to the guide lever, is greater in the unused position and/or in the intermediate position than in the usage position.

* * * * *